US010435188B2

(12) United States Patent
Rasi

(10) Patent No.: US 10,435,188 B2
(45) Date of Patent: Oct. 8, 2019

(54) MACHINE FOR WRAPPING GROUPS OF PRODUCTS IN A ROLL AND PACKAGING PROCESS

(71) Applicant: TISSUE MACHINERY COMPANY S.p.A., Castel Guelfo (Bologna) (IT)

(72) Inventor: Michele Rasi, Ferrara (IT)

(73) Assignee: TISSUE MACHINERY COMPANY S.p.A., Castel Guelfo (Bologna) (IT)

( * ) Notice: Subject to any disclaimer, the term of this patent is extended or adjusted under 35 U.S.C. 154(b) by 293 days.

(21) Appl. No.: 15/583,186

(22) Filed: May 1, 2017

(65) Prior Publication Data

US 2017/0320605 A1 Nov. 9, 2017

(30) Foreign Application Priority Data

May 5, 2016 (IT) ..... 102016000046569

(51) Int. Cl.
*B65B 25/14* (2006.01)
*B65B 41/02* (2006.01)
(Continued)

(52) U.S. Cl.
CPC ..... *B65B 25/146* (2013.01); *B65B 11/10* (2013.01); *B65B 11/20* (2013.01); *B65B 41/02* (2013.01)

(58) Field of Classification Search
CPC ..... B65B 11/10; B65B 11/20; B65B 41/20; B65B 25/146
(Continued)

(56) References Cited

U.S. PATENT DOCUMENTS 5,331,788 A * 7/1994 Cinotti ..... B65B 11/20 53/228
2002/0059779 A1 5/2002 Gamberini
(Continued)

FOREIGN PATENT DOCUMENTS

JP S62 194506 U 12/1987
WO 02/02408 A1 1/2002

*Primary Examiner* — Robert F Long
*Assistant Examiner* — Xavier A Madison
(74) *Attorney, Agent, or Firm* — Renner, Otto, Boisselle & Sklar, LLP

(57) ABSTRACT

Described is a machine for wrapping groups (1) of products in a roll, comprising: a packaging unit (2) positioned above a feed channel (3); a transfer element (5) configured for feeding, in a feed direction (V5), to the packaging unit (2) the groups (1) of products in a roll with a corresponding sheet of wrapping material (6); feed and positioning units (8) configured for feeding the sheet (6) of wrapping material inside the vertical channel (3), in a direction (T6) transversal to the direction (V5) for feeding the group (1) of products; the machine also comprises means (9) for controlled retaining and unwinding of the sheet (6) of wrapping material positioned along the vertical feed channel (3); a first movement unit (10) connected to the controlled retaining and unwinding means (9) and configured to move the controlled retaining and unwinding means (9) from a position of free passage of the sheet (6) of wrapping material to a position for bilateral retaining of the sheet (6) of wrapping material positioned in the channel (3); a second movement unit (11) connected to the controlled retaining and unwinding means (9) and configured to move the controlled retaining and unwinding means (9), located in the retaining position, so as to unwind the sheet (6) of wrapping material in a controlled manner and at the movement of the transfer element (5) from the first lower operating position to a second upper operating position.

9 Claims, 3 Drawing Sheets

(51) Int. Cl.
*B65B 11/10* (2006.01)
*B65B 11/20* (2006.01)

(58) Field of Classification Search
USPC ..... 53/228, 438, 504; 198/803.13
See application file for complete search history.

(56) References Cited

U.S. PATENT DOCUMENTS

2005/0229546 A1* 10/2005 Poli ..... B65B 11/22
53/466
2014/0260087 A1* 9/2014 Antoniazzi ..... B65B 11/26
53/138.2

* cited by examiner

MACHINE FOR WRAPPING GROUPS OF PRODUCTS IN A ROLL AND PACKAGING PROCESS

This application claims priority of Italian Patent Application No. 102016000046569 filed May 5, 2016, which is hereby incorporated herein by reference.

BACKGROUND OF THE INVENTION

This invention relates to a machine for wrapping groups of products in a roll, in particular tissue paper products such as, for example, rolls of toilet paper and/or kitchen paper or products in boxes containing tissue paper products, such as, for example, tissues.

In the packaging of products in a roll—in particular multiple groups of toilet paper or kitchen paper products—wherein the packaging comprises the wrapping of the group of products with a sheet of wrapping material (normally a plastic film), a very highly felt problem is that of obtaining a correct relative positioning of the sheet of wrapping material relative to the product being wrapped before they are inserted as one in the packaging machine.

In effect, this association may be obtained, in the embodiment most commonly used in packaging machines, in a feed station of the machine, which is widely located beneath or alongside an infeed station of the packaging machine, and which has an elevator/conveyor equipped with a loading table which can move alternately towards and away from the machine. The loading table, which is movable between fixed sides, receives the products in a first lowered/withdrawn position and transfers them inside the machine when the relative maximum lifting/transfer position is reached.

During the execution of the feed stroke of the conveyor the products intercept the sheet of wrapping material which has been positioned across the trajectory of the moving products and which is held in a stationary condition by suitable gripping elements.

The above-mentioned operational interaction means that the sheet of wrapping material is:

intercepted by the front end of the product being raised;

disassociated from the gripping elements; and pulled, lastly, by the product into the packaging machine.

During this operation the sheet simply rests against the front of the product being transferred; and substantially "swinging" relative to the sides of the product with the free flaps or edges of lateral ends floating substantially freely beyond the lower base of the product.

An example of these stations is known from patent document US 2002/059779 which illustrates a unit for transferring packs of rolls to be packaged in respective films from an intermediate station to subsequent stations. The unit comprises pushing members activated in phase with the positioning of a pack of rolls wrapped laterally by a relative film in the intermediate station. These pushing members intercept laterally the pack of rolls wrapped so as to translate them laterally at the outfeed from the intermediate station.

The release of the sheet, by the gripping elements, and the subsequent pulling of the sheet by the product have always represented critical phases of the feeding, during which the sheet, as it has quite a high a freedom of movement, is susceptible to potential position variations relative to the product to be wrapped. When the sheet does not have printing, wording and/or decorations, any limited variation of the initial positioning may lead to a certain irregularity of the package which, however, if it is not excessive, may generally be tolerated even though it does result in an inherent reduction in the quality of the package.

If, however, the sheet is provided with decorations, wording, printing, that is to say, distinctive signs of the product, even modest variations in positioning and centring of these distinctive signs relative to the product contained inside the package may prove to be completely unacceptable for good or high quality packages.

In addition to this type of known problem there is the fact that, typically for packages having four or more rolls of toilet paper or two or more rolls of kitchen paper, or tissue paper products in boxes, sheets with a thickness of more than 25 um are used, whilst the materials used are typically LDPE (low-density polyethylene) mono-extruded or co-extruded in several layers and then printed with multiple colours.

As mentioned, the presence of printing, like the presence of ionised zones which are more or less uniform joined with the ions which are formed during the first detachment of the layers of superposed film (often configured in feed reels) make the handling of the product sufficiently complex.

Now, however, the requirements of the manufacturers of these types of groups of products are leading towards a reduction in the thickness of the film to achieve an overall saving in the costs of the packages.

These reductions further emphasise the above-mentioned drawbacks:

- wrinkling during transport (from the area for unwinding from a roll to the area for raising the product);
- possible misalignments (on the sides) of the flaps of the moving film;
- slipping caused by the low coefficient of friction which the conveyer belts offer.

The sum of the drawbacks transforms into:

- reduction in the wrapping speed to increase the control of the film;
- reduction in quality linked to misalignment defects which result in products rejects at the outfeed to the wrapping machine.

SUMMARY OF THE INVENTION

The aim of this invention is to provide a machine for packaging groups of products in a roll, in particular tissue paper products such as, for example, rolls of toilet paper and/or kitchen paper which overcomes the above-mentioned drawbacks of the prior art.

More specifically, the aim of this invention is to provide a machine for packaging groups of products in a roll, in particular tissue paper products such as, for example, rolls of toilet paper and/or kitchen paper which is able to keep the optimum relative positioning of the film and the group of products for the entire duration of feeding to the packaging machine.

A further aim of this invention is to provide a machine for packaging groups of products in a roll, in particular tissue paper products such as, for example, rolls of toilet paper and/or kitchen paper which is able to allow the use of thicknesses of heat-sealable plastic having average thicknesses less than the average of the thicknesses used until now, whilst maintaining a high end quality of the packaged product.

These aims are fully achieved by a machine for packaging groups of products in a roll, in particular tissue paper products such as, for example, rolls of toilet paper and/or kitchen paper according to this invention, as characterised in the appended claims.

BRIEF DESCRIPTION OF THE DRAWINGS

This and other features of the invention will become more apparent from the following description of a preferred embodiment of it, illustrated by way of non-limiting example in the accompanying drawings, in which.

DESCRIPTION OF THE PREFERRED EMBODIMENTS

Figure 4:
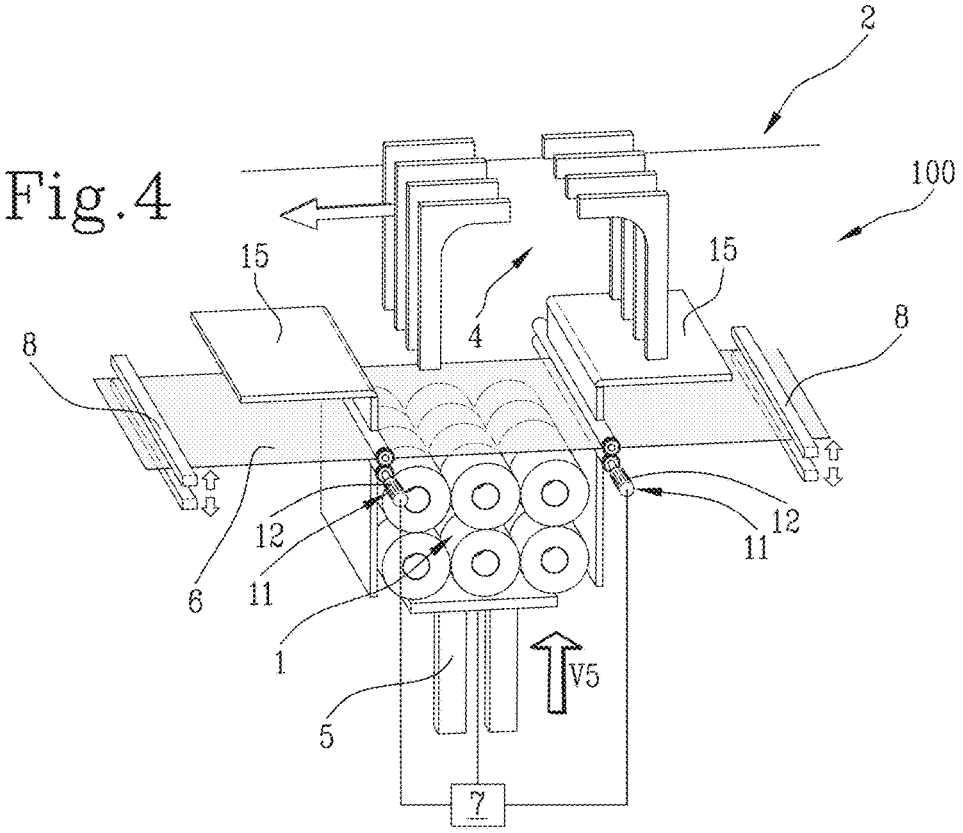
FIG. 4 is a front perspective view with some parts removed to better illustrate others of the machine for wrapping groups of products in rolls according to this invention in a fourth operating configuration.
Figure 5:
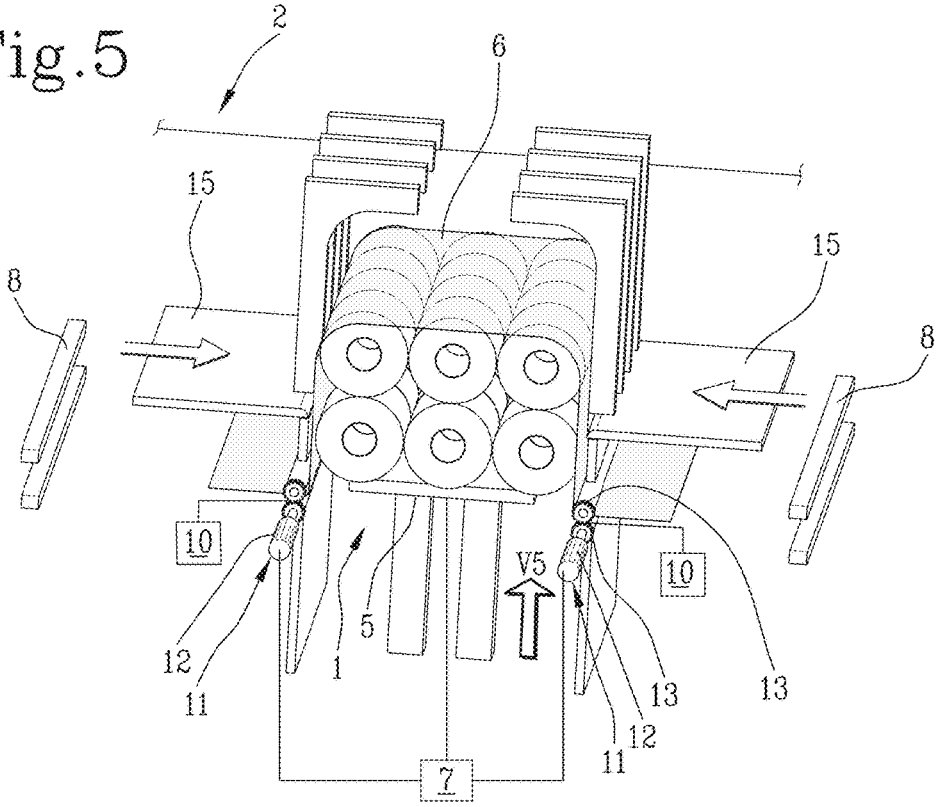
FIG. 5 is a front perspective view with some parts removed to better illustrate others of the machine for wrapping groups of products in rolls according to this invention in a fifth operating configuration.
Figure 6:
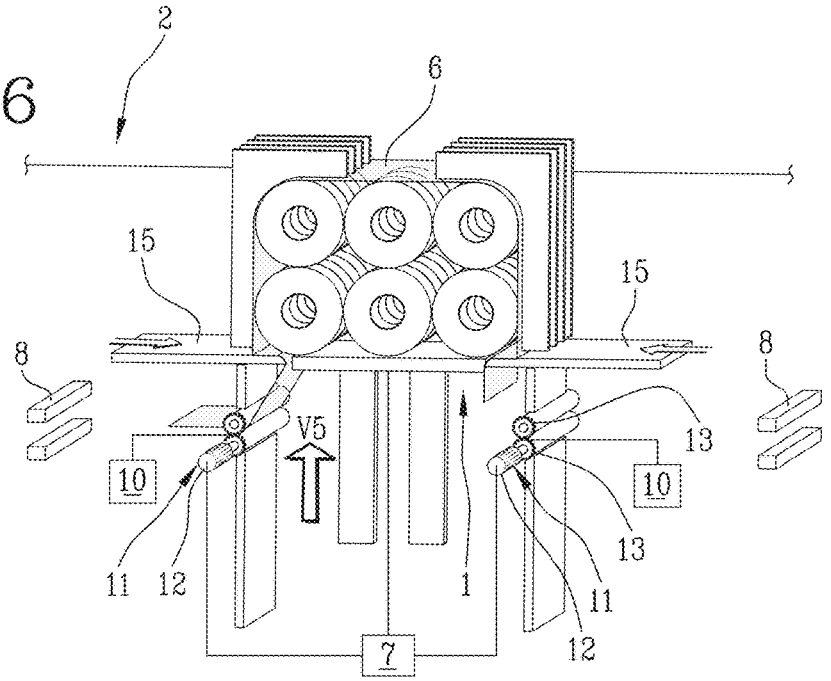
FIG. 6 is a front perspective view with some parts removed to better illustrate others of the machine for wrapping groups of products in rolls according to this invention in a sixth operating configuration.

As illustrated in the accompanying drawings, and in particular in FIGS. 4 to 6, the machine according to the invention, labelled 100 in its entirety, is used for wrapping groups 1 of products in a roll, in particular tissue paper products such as, for example, rolls of toilet paper and/or kitchen paper or products in boxes containing tissue paper products, such as, for example, tissues.

It should be noted that the construction example of the machine according to this invention is of the vertical feed type, but that does not limit the solution with packaging machines with product feed to the packaging along a horizontal direction.

The machine 100 comprises a packaging unit 2 positioned facing (above) a feed channel 3 (vertical).

The unit 2 has a conveyor equipped with a plurality of pockets 4, each of which has the shape of an inverted "U" and which can be positioned, in sequence, facing the vertical feed channel 3.

The machine 10 also comprises a transfer element 5 (a plate) configured for feeding, in a feed direction V5 (vertical), to the pockets 4 of the packaging unit 2, the groups 1 of products in a roll with a corresponding sheet of wrapping material 6.

The transfer element 5 has movement means 7 configured for moving, at a first speed, the transfer element 5 at least from a first operating position (lower, not illustrated), for receiving groups 1 of products in a roll, to a second operating position (upper, FIG. 6), releasing the group 1 of products in a roll, and the sheet 6 of wrapping material intercepted by the group 1 of products, to the corresponding pocket 4 (drive teeth) of the packaging unit 2.

The machine 100 also comprises feed (pairs of drive belts) and positioning units 8 configured for feeding the sheet 6 of wrapping material inside the vertical channel 3, in a direction T6 transversal to the direction V5 (vertical) for feeding the group 1 of products.

As illustrated, the machine 100 also comprises means 9 for controlled retaining and unwinding of the sheet 6 of wrapping material positioned along the vertical feed channel 3.

The machine 100 also comprises a first movement unit 10 connected to the controlled retaining and unwinding means 9 and configured to move the controlled retaining and unwinding means 9 from a position of free passage of the sheet 6 of wrapping material to a position for bilateral retaining of the sheet 6 of wrapping material positioned in the vertical channel 3.

The machine 100 also comprises a second movement unit 11 connected to the controlled retaining and unwinding means 9 and configured to move the controlled retaining and unwinding means 9, located in the retaining position, so as to unwind the sheet 6 of wrapping material in a controlled manner and at the movement of the transfer element 5 from the first lower operating position to the second upper operating position.

In other words, the retaining and unwinding means have the dual purpose of keeping the sheet in position after its arrival in the channel and adjusting its unwinding in line with the winding of the group of products moving upwards, keeping the sheet in the correct position without veering or misalignments thanks to the correct releasing movement.

Preferably, the controlled retaining and unwinding means 9 comprise two pairs of rollers 9*a*, 9*b* positioned on both sides of the vertical feed channel 3. Each roller 9*a*, 9*b* has a relative axis X9*a*, X9*b* of longitudinal extension parallel to the transversal direction T6 for feeding the sheet 6 of wrapping material. Each pair of rollers 9*a*, 9*b* has the corresponding axes X9*a*, X9*b* of extension parallel to each other in the bilateral retaining position of the sheet 3 of wrapping material (FIGS. 3 to 6).

In light of this, at least one roller 9*a* or 9*b* of each pair of rollers has one end pivoted to the first movement unit 10 to allow its inclination, by an angle $\alpha$, of moving away from the other roller 9*b* or 9*a*.

It should be noted that the first movement unit 10 is connected to one end of the roller 9*a* or 9*b* which can be inclined on the opposite side to a path for the infeed into the vertical feed channel 3 of the sheet 6 of wrapping material.

Alternatively, both the rollers 9*a* or 9*b* of each pair of rollers have a corresponding end pivoted to the first movement unit 10 to allow their inclination, by an angle $\alpha$ of mutual moving away in a scissor-like fashion.

In other words, each pair of rollers may open in a "scissor-like" fashion to allow the entry of the sheet in the vertical channel and then close to retain the sheet until the sheet is intercepted by part of the upper surface of the group of products. At this point, the pairs of rollers are activated and allow the controlled unwinding of the film correlated with the raising of the group of products.

Alternately, at least one of the rollers 9*a* or 9*b* is connected to the first movement unit 10 configured to allow its lifting or lowering parallel to the other roller 9*b* or 9*a*.

Preferably, at least one roller 9*a*, 9*b* of each pair of rollers has a surface of contact with the sheet 6 of wrapping material with high friction coefficient characteristics (for example, a rubber coated surface). This prevents any slipping in the presence of surfaces which are decorated and have a reduced adherence. In effect, the rubber coated surface annuls any imperfections of the film which, being printed in one of the two surfaces, will have variable thicknesses (where the colour is present the thickness is greater).

Preferably, the second movement unit 11 (motorised unit) is connected to the means 7 for movement of the transfer element 5 for synchronising the speed of unwinding of the sheet 6 of wrapping material by the controlled retaining and unwinding means 9 with the first speed of movement of the transfer element 5.

In light of this, the controlled retaining and unwinding means 9 have an unwinding speed equal to the speed of movement of the transfer element 5.

In a non-limiting example embodiment, the second movement unit 11 comprises a drive unit 12 for each pair of rollers 9*a*, 9*b*.

Each pair of rollers 9*a*, 9*b* has a kinematic system 13 connected to the relative drive unit 12 and configured to allow a rotation according to directions opposite to each other of the rollers 9*a*, 9*b* of each pair of rollers.

In an alternative solution (not illustrated), the movement unit 11 may comprise mechanical systems for direct connection with the means 7 for movement of the transfer unit 5.

Preferably, the vertical feed channel 3 is defined by a pair of vertical panels 3*a*, 3*b* each having an interruption area 14 for positioning the sheet 6 of wrapping material.

In light of this, the controlled retaining and unwinding means 9 are positioned inside respective interruption areas 14.

The positioning of the rollers is therefore substantially coplanar with the panels to keep the vertical channel 3 free for the passage of the groups of products.

As may be seen in the drawings, the operational steps of the machine structured in this way are as follows.

Figure 1:
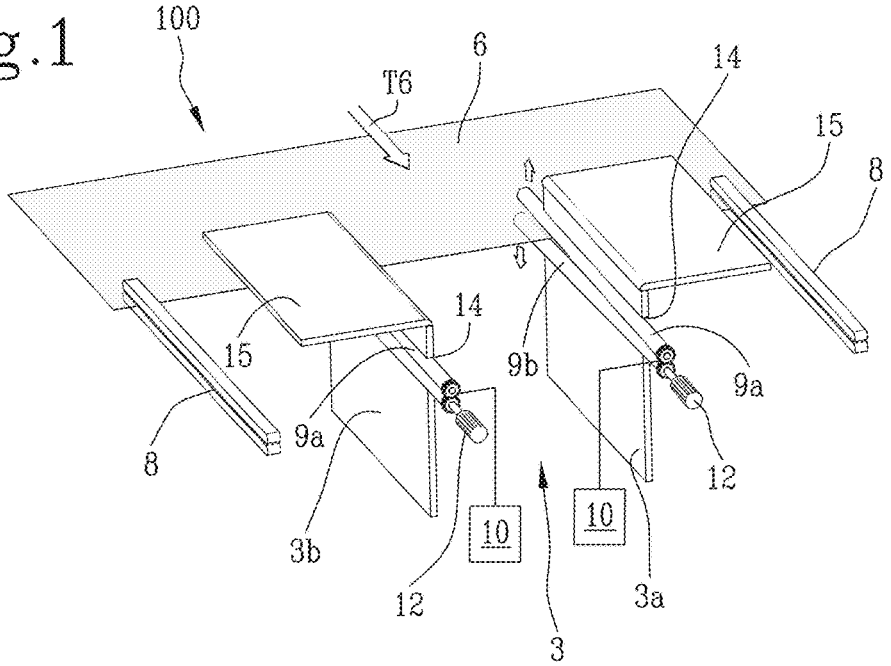
FIG. 1 is a front perspective view with some parts removed to better illustrate others of the machine for wrapping groups of products in rolls according to this invention in a first operating configuration.

The sheet 6 is pulled by the belts 8 towards the channel 3 in the direction T6 (FIG. 1).

Figure 2:
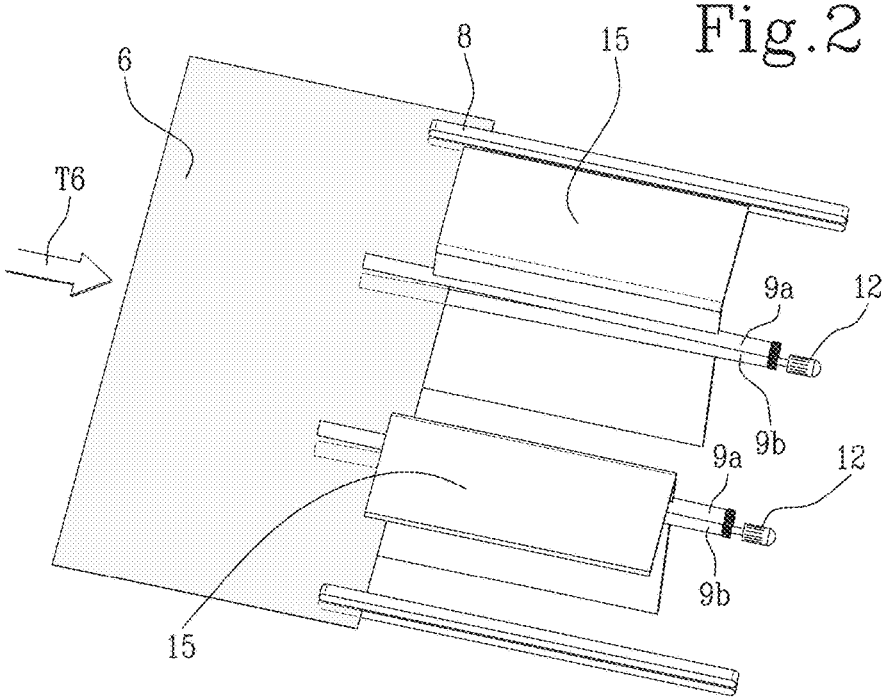
FIG. 2 is a perspective view from above with some parts removed to better illustrate others of the machine for wrapping groups of products in rolls according to this invention in a second operating configuration.

The pairs of rollers 9*a* and 9*b* are opened in a scissor-like fashion (with pivot on the side opposite the travel of the sheet 6) for allowing entry of the sheet 6 in the channel 3 (FIG. 2).

Figure 3:
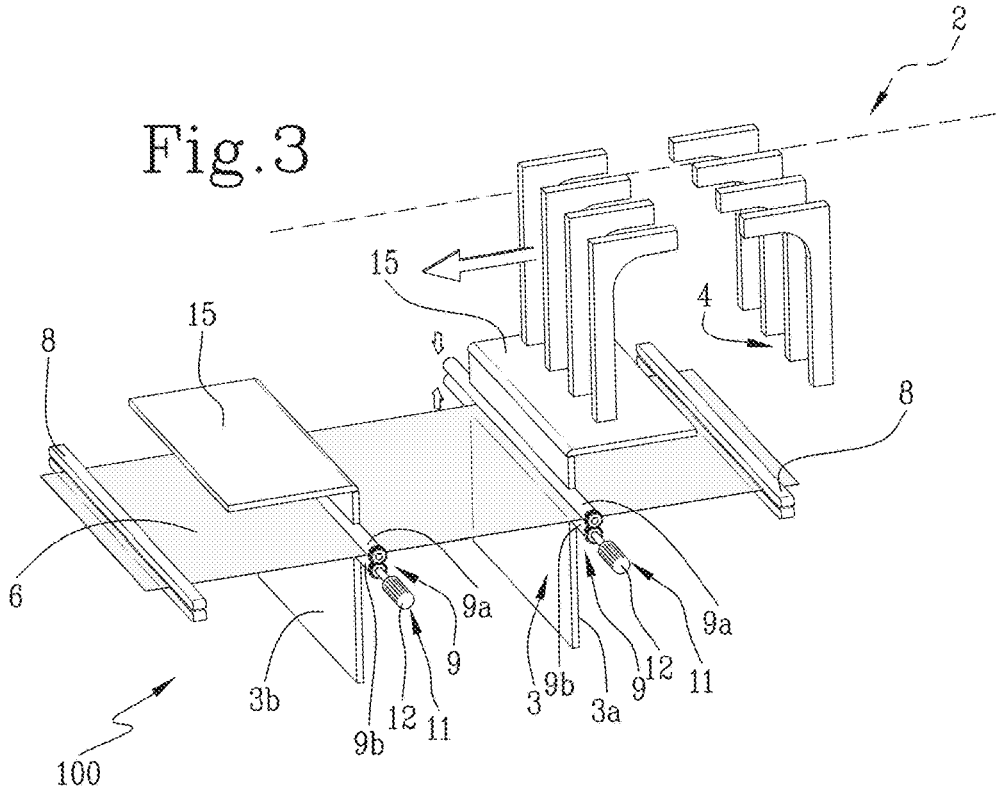
FIG. 3 is a front perspective view with some parts removed to better illustrate others of the machine for wrapping groups of products in rolls according to this invention in a third operating configuration.

After the step for entrance of the sheet 6, the pairs of rollers 9*a*, 9*b* start to close, thus guaranteeing the gripping of the sheet (with "clamp" effect) (FIG. 3).

At this point, a pocket 4 of the conveyor is positioned above the vertical feed channel 3. (FIG. 3)

The transfer element 5 transfer (lift plate) starts the upstroke with the group of products towards the sheet 6 (FIG. 4).

Simultaneously with the rising of the groups of rolls which begin to touch the sheet, the rollers 9*a*, 9*b* start to unwind (for example, the upper roller in the anticlockwise direction, the lower roller in the clockwise direction) with a speed which is at least equal to that of the elevator (FIG. 5).

Alternatively, the speed of the rollers may also have a positive or negative gap (if the unwinding speed is less than the rising speed the sheet will be tensioned, if it is higher the sheet will be slightly slack).

The lift plate pushes the group of products and at the same time the sheet is unwound from the pairs of lateral rollers. The flap of the short sheet (to the right in FIGS. 5 and 6) is pulled out by the rollers before the long flap (to the left in FIGS. 5 and 6).

In light of this, the pair of rollers acting on the long flap continue to unwind until the elevator has performed the entire upstroke with the speed of the elevator which will tend to reduce decelerating to speed "0".

Preferably, as soon as the downstroke of the elevator starts and the lower folders 15 (of the free flaps of the sheet) begin their stroke, the pair of rollers which has the longer flap unwinds until the front of the sheet for the next cycle arrives.

At that moment the rollers must start to open again (in scissor-like fashion).

It should be noted that during the downstroke of the lift plate a portion of flap of the sheet could still be resting on the lower roller.

For this reason, the rollers of the long flap part invert their motion—facilitating the downward motion of the lift plate—so the lower roller in an anticlockwise direction frictions the effect of the lower folder which is tucking in the film in the lower area of the pack.

What is claimed is:

1. A packaging machine for wrapping groups of products in a roll, comprising at least:

a packaging unit positioned close to a feed channel; the unit having a conveyor equipped with a plurality of pockets, each of which has the shape of an inverted "U" and which can be positioned, in sequence, facing the feed channel;

a transfer element configured for feeding, in a feed direction, to the pockets of the packaging unit, the groups of products in a roll with a corresponding sheet of wrapping material; the transfer element having movement means configured for moving, at a first speed, the transfer element at least from a first operating position, for receiving the groups of products in a roll, to a second operating position releasing the group of products in a roll and the sheet of wrapping material intercepted by the group of products to the corresponding pocket of the packaging unit;

feed and positioning units configured for feeding the sheet of wrapping material inside the vertical channel, in a direction transversal to the direction for feeding the group of products;

wherein it comprises:

means for controlled retaining and unwinding of the sheet of wrapping material positioned along the feed channel;

a first movement unit connected to the controlled retaining and unwinding means and configured to move the controlled retaining and unwinding means from a position of free passage of the sheet of wrapping material to a position for bilateral retaining of the sheet of wrapping material positioned in the feed channel;

a second movement unit connected to the controlled retaining and unwinding means and configured to move the controlled retaining and unwinding means, located in the retaining position, so as to unwind the sheet of wrapping material in a controlled manner and at the movement of the transfer element from the first operating position to the second operating position.

2. The machine according to claim 1, wherein the controlled retaining and unwinding means comprise two pairs of rollers positioned on both sides of the feed channel; each roller having a relative axis of longitudinal extension parallel to the transversal direction for feeding the sheet of wrapping material; each pair of rollers having the corresponding axes of extension parallel to each other in the bilateral retaining position of the sheet of wrapping material.

3. The machine according to claim 2, wherein at least one roller of each pair of rollers has one end pivoted to the first movement unit to allow its inclination, by an angle of moving away from the other roller; the first movement unit being connected to one end of the roller which can be inclined.

4. The machine according to claim 2, wherein both the rollers of each pair of rollers have a corresponding end pivoted to the first movement unit to allow their inclination, by an angle of mutual moving away in a scissor-like fashion; the first movement unit being connected to one end of each roller which can be inclined.

5. The machine according to claim 2, wherein at least one roller of each pair of rollers has a surface of contact with the sheet of wrapping material with high friction coefficient characteristics.

6. The machine according to claim 1, wherein the second movement unit is connected to the means for movement of the transfer element for synchronising the speed of unwinding of the sheet of wrapping material by the controlled retaining and unwinding means with the first speed of movement of the transfer element.

7. The machine according to claim 6, wherein the controlled retaining and unwinding means have an unwinding speed equal to the speed of movement of the transfer element.

8. The machine according to claim 2, wherein the second movement unit comprises a drive unit for each pair of rollers; each pair of rollers having a kinematic system connected to the relative drive unit and configured to allow a rotation according to directions opposite to each other of the rollers of each pair of rollers.

9. The machine according to claim 1, wherein the vertical feed channel is defined by a pair of vertical panels each having an interruption area for positioning the sheet of wrapping material, and wherein the controlled retaining and unwinding means are positioned inside the corresponding interruption areas.

* * * * *